United States Patent [19]

de Nora et al.

[11] 4,288,302

[45] Sep. 8, 1981

[54] METHOD FOR ELECTROWINNING METAL

[75] Inventors: Vittorio de Nora, Nassau, The Bahamas; Giuseppe Bianchi; Antonio Nidola, both of Milan, Italy

[73] Assignee: Diamond Shamrock Technologies S.A., Geneva, Switzerland

[21] Appl. No.: 763,889

[22] Filed: Jan. 31, 1977

Related U.S. Application Data

[62] Division of Ser. No. 436,687, Jan. 25, 1974, abandoned.

[30] Foreign Application Priority Data

Jan. 26, 1973 [IT] Italy ..... 19679 A/73

[51] Int. Cl.[3] ..... C25B 1/02; C25C 1/00; C25B 11/10

[52] U.S. Cl. ..... 204/105 R; 204/129; 204/293

[58] Field of Search ..... 204/293, 105 R, 129

[56] References Cited

U.S. PATENT DOCUMENTS 2,337,475 12/1943 Kuss et al. ..... 204/118

3,745,101 7/1973 Currey et al. ..... 204/98

FOREIGN PATENT DOCUMENTS 4541201 3/1967 Japan ..... 204/247

*Primary Examiner*—R. L. Andrews

*Attorney, Agent, or Firm*—Hammond & Littell, Weissenberger and Muserlian

[57] ABSTRACT

Novel dimensionally stable electrodes constituted by a film forming metallic material alloyed with at least one member of the group consisting of metal belonging to Groups VIB, VIIB, VIII, IIB, IB, IVA, lanthanum and lanthanide series of the Periodic Table, such as chromium, manganese, rhenium, iron, ruthenium, osmium, cobalt, rhodium, iridium, nickel, palladium, platinum, copper, silver, gold, zinc, cadmium, silicon, germanium, tin, lead and lanthanum having an electroconductive and corrosion resistant surface preactivated on the surface thereof, preparation of said electrodes, use of said electrodes as anodes for electrolysis in aqueous and organic solutions or in fused salts as well as for cathodic protection and electrolysis methods using said electrodes.

12 Claims, No Drawings

METHOD FOR ELECTROWINNING METAL

This is a division of Ser. No. 436,689, filed Jan. 25, 1974, now abandoned.

STATE OF THE ART

Recently dimensionally stable electrodes for anodic and cathodic reactions in electrolysis cells have been used, for example, in the manufacture of chlorine and caustic by electrolysis of aqueous solutions of alkali metal chloride, for metal electrowinning in hydrochloric acid and sulfuric acid solutions, and for other processes in which an electric current is passed through an electrolyte for the purpose of decomposing the electrolyte, for carrying out organic oxidations and reductions, or to impress a cathodic potential to a metallic structure which has to be protected from corrosion.

They have been particularly valuable in flowing mercury cathode cells and in diaphragm cells for the production of chlorine and caustic, in metal electrowinning cells in which pure metal is recovered from a chloride or sulfate solution as well as in the cathodic protection of ship hulls and structures.

Dimensionally stable electrodes have been prepared with valve metal bases, such as titanium, tantalum, zirconium, hafnium, vanadium, niobium, molybdenum and tungsten, or "film forming" alloys, which in service develop a corrosion resistant but non-electrically conductive oxide or barrier layer which prevents the further flow of anodic current through the anode except at substantially higher voltage and, therefore, cannot be used successfully as anodes. It has, therefore, been considered necessary to cover at least a portion of the valve metal such as a titanium or tantalum anode with a conductive layer of noble metal from the platinum group (i.e., platinum, palladium, iridium, osmium, rhodium, ruthenium) or conductive and catalytic noble metal oxides as such or mixed with valve metal oxides and other metal oxides. These conductive layers usually completely covered the electrically conductive base except for inevitable pores throught the coating, which pores were, however, sealed by the development of the barrier layer above referred to on the "film forming" base.

Coating made of, or containing, a platinum group metal or of platinum group metal oxides are, however, expensive and are consumed or deactivated in the electrolysis process and, therefore, reactivation processes or recoatings are necessary to replace deactivated anodes. Up to now, the commercial electrodes for chlorine and oxygen evolution have been prepared by coating a valve metal base with a noble metal from the platinum group or with either a separately applied coating containing oxides or with separately applied coating compositions which under thermal treatment generate a layer containing oxides.

OBJECTS OF THE INVENTION

It is an object of the invention to provide novel long lasting electrodes which are mechanically and chemically resistant to the conditions found in electrolytic cells as well as in cathodic protection, and which do not require separately applied conductive coatings.

It is another object of the invention to provide novel processes for the preparation of electrodes for electrolysis cells.

It is another object to provide methods for pre-activating, whenever necessary, electrodes made with the metal of the electrode for use in electrolysis cells.

It is a further object of the invention to provide novel electrolysis methods using the electrodes of the invention.

It is another object of the invention to provide novel dimensionally stable electrodes which form their own active coating when used as anodes and are not passivated by prolonged operation.

Another object of the invention is to provide electrodes to be used as anodes which are able to generate a layer of oxides on their surface from the alloy forming the electrode or by automatic self-regeneration in an electrolysis cell with oxygen evolution.

It is a further object of the invention to provide a novel method of producing electrodes by alloying a valve metal with at least one metal belonging to Groups VIB, VIIB, VIII, IIB, IB, IVA, lanthanum and lanthanide series of the Periodic Table, such as chromium, manganese, rhenium, iron, ruthenium, osmium, cobalt, rhodium, iridium, nickel, palladium, platinum, copper, silver, gold, zinc, cadmium, tin, lead, silicon, germanium and lanthanum and activating, whenever necessary, said electrodes.

It is another object of the invention to provide a novel method of producing corrosion resistant electrodes by sintering a mixture of metal powders comprising at least a valve metal powder and a metal powder of at least one metal belonging to Groups VIB, VIIB, VIII, IIB, IB, IVA, lanthanum and lanthanide series of the Periodic Table, such as chromium, manganese, rhenium, iron, ruthenium, osmium, cobalt, rhodium, iridium, nickel, palladium, platinum, copper, silver, gold, zinc, cadmium, tin, lead, silicon, germanium and lanthanum and activating, whenever necessary, said electrodes.

It is another object of the invention to provide a novel method of producing corrosion resistant electrodes by sintering a mixture of metal powder and metal oxides, intermetallic compounds or metallates powder, the latter providing conductive nuclei on the surface of the electrode which remains permanently actived.

It is an additional object of the invention to provide methods to pre-activate the surfaces of the novel electrodes of the invention.

These and other objects and advantages of the invention will become obvious from the following detailed description.

THE INVENTION

It has now surprisingly been found that by alloying the film forming metals such as titanium, tantalum, niobium, tungsten, zirconium, hafnium, or silicon-iron alloys or other corrosion resistant iron alloys such as Si-Cr-Fe, Si- Mo-Fe and Cr-Mo-W-Fe alloys with appropriate quantities of certain other metals, the alloys obtained develop, under anodic polarization, an electrically conductive film and we have been able to obtain alloys whose developed surface films, besides being electrically conductive, show also high catalytic properties.

Alloys prepared according to the invention when connected into an electrolysis circuit have been used as electrodes working at low and economically acceptable overvoltages with extremely high mechanical and chemical resistance.

the novel electrodes of the invention are constituted by a film forming a corrosion resistant metallic material alloyed with at least one member of the group consisting of metals belonging to Groups VIB, VIIB, VIII, IIB, IB, IVA, lanthanum and lanthanide series of the Periodic Table. A layer of oxide is generated under operation or performed on the alloy by methods which are hereunder described.

In another embodiment of the invention powder of a valve metal or of a film forming alloys such as high silicon content Si-Fe alloys or alloys such as Si-Cr-Fe, Si-Mo-Fe, Cr-Mo-W-Fe, etc. is sinterized with powder of either at least a metal belonging to Groups VIB, VIIB, VIII, IIB, IB, IVA, lanthanum and lanthanide series of the Periodic Table or oxides, metallates or intermetallic compounds of the same metals.

In this case the additive elements or compounds constitute the electrocatalytically active and electroconductive nuclei on the surface of the sinterized electrode.

In the latter embodiment it is not necessary that the concentration of the additive element or compound be uniform through the entire section of the sinterized electrode but, by appropriate powder mixing technique or other means, the suitable concentration of the additional metal or metal compound can be achieved only in the surface layers leaving the bulk of the sinterized electrode composed only by the matrix material.

It has been found that in most cases the amount of the metal or metal compound added is sufficient to be as low as 0.1% by weight and can be as high as 50% by weight or more.

Examples of film forming metals are titanium, tantalum, zirconium, hafnium, vanadium, molybdenum, niobium and tungsten.

Examples of a film forming metal alloy is a silicon-iron alloy, wherein the silicon content is 14.5% by weight as metallic silicon or alloys such as Si-Cr-Fe, Si-Mo-Fe, Cr-Mo-W-Fe, etc.

Examples of metals belonging to Groups VI, VIIB, VIII, IIB, IB, IVA, lanthanum and lanthanide series of the Periodic Table are chromium, manganese, rhenium, iron, ruthenium, osmium, cobalt, rhodium, iridium, nickel, palladium, platinum, copper, silver, gold, zinc, cadmium, tin, lead silicon, germanium and lanthanum. The amount of said metals in the alloys can be as low as 0.1 and as high as 50%, preferably 10 to 30%, by weight of the alloy.

Among preferred electrode embodiments of the invention are electrodes made of titanium or any of other film forming metals with 1 to 50% by weight of nickel or cobalt or an alloy of iron-silicon containing up to 20% of silicon, preferably 14.5% and 0.5 to 10% by weight of molybdenum or chromium. By increasing the amount of molybdenum or chromium or by adding nickel or cobalt, the amount of silicon in the alloy can be much lower.

The said electrodes are then subjected to one of the following activation processes which forms a layer of oxides of the metals constituting the alloy on the outer surface of the electrode or mixed crystals of oxides of said metals. Other activation processes than those specifically described may be used. The anodes of the invention are able to withstand operating conditions in commercial electrolysis cells for chlorine production equally as well as valve metal anodes coated with an active layer of a platinum group metal or an oxide of a platinum group metal of the prior art, and they operate for cathodic protection as well as titanium anodes coated with an active layer as described in the prior art.

The anodes are preferably cleaned before subjected to the activation processes described herein. This may be effected by sandblasting or by light etching in hydrochloric acid for 5 to 45 minutes followed by washing with distilled water or by other cleaning processes.

The electrodes are also provided, before or after activation, with means to connect the electrodes to a source of electric current.

One means of activating the electrode comprises dipping the electrode in a molten salt for up to 10 hours at a temperature slightly higher than the melting point of the specific molten salt. Said salt are preferably inorganic alkali metal oxidizing salts or mixtures thereof such as sodium, nitrate, potassium, persulfate, potassium pyrophosphate, sodium perborate and the like.

Another method of activating the electrodes comprises heating the electrodes in an oxidizing atmosphere to a temperature of from 500° to 1200° C. for up to 10 hours and optionally maintaining the electrodes at such temperature in an inert atmosphere such as nitrogen or argon for up to 10 hours. Preferably, the electrodes are slowly cooled at a rate of 10° to 80° C. per hour, usually in an inert atmosphere.

A third method of activating the electrodes comprises anodic polarization of the electrode in an aqueous sulfuric acid solution or an aqueous alkaline solution with a current density preferably of 600 to 3000 $A/m^2$ at 30° to 50° C. for up to 10 hours. Other activation methods which will oxidize the alloy may be used to form active coatings on the surface of the alloy metal of the electrode. Stated limits for temperature, time of oxidizing treatment, current density are only indicative in so far during experiments it has been found that comparable performance results were obtained from test coupons after a definitive pre-activation treatment while for another set of different test coupons such a limit would be somewhat different.

Therefore it is assumed that the optimum conditions for pre-treatment will be easily recognized by the expert of the art when practicing the present invention.

The activation methods of the invention appear to promote the formation of a mixed crystal or a composite crystal layer of oxides of the metals forming the outer surface of the alloy electrode base, which layer covers the entire surface of the electrode base and in the instances where measurements have been made is approximately 1 to 30 microns thick. The oxide layer may, however, cover only a portion of the electrode metal.

In a modification of the invention, the cleaned electrode base without any pre-activation treatment may be used as an anode for oxygen evolution by electrolysis of a suitable aqueous electrolyte as, for instance, an electrolyte as used in the electrowinning of metals. A thin layer of peroxide type compounds appears to be formed as soon as the electrodes are operated as anodes in such an oxygen evolution electrolysis, either in sulfuric or in phosphoric acid solutions. These anodes are exceptionally valuable for use in electrowinning of metals where sulfuric acid solutions of the metal are electrolyzed with oxygen formed at the anode and the metal to be won, such as copper, being deposited on the cathode, and have the advantages of being economically produced and of the activation being self-regenerating during the electrolysis process.

The electrodes of this invention are particularly useful for electrowinning processes used in the production of various metals because they do not add impurities to the electrolytic bath which would deposit onto the cathode, together with the metals being won, as do anodes of, for example, lead containing antimony and bismuth, which give impure cathode refined metals. Moreover, their resistance to acid solutions and to oxygen evolution and their low anode potential make them desirable for this use.

By the words "alloy" or "alloyed" used freely throughout the present disclosure, for sake of simplicity, we intend to identify, where relevant, the true solid solutions of one or more metals into the crystal lattice of another metal, or intermetallic compounds, oxides and metallates, as well as "mixtures" of said metals, oxides, intermetallic compounds and metallates wherein the degree of solution is incomplete or even quite small, like in the case when the "alloy" is obtained by sinterization of a mixture of metals, metal oxides, intermetallic compounds or metallates containing the appropriate metals or compounds in the correct proportions.

In the following examples several preferred embodiments are described to illustrate the invention. However, it should be understood that the invention is not intended to be limited to the specific embodiments.

EXAMPLE 1

Six coupons of a titanium-nickel (98.5% to 1.5%) alloy having a projected area of 4 $cm^2$ were sandblasted and were than activated by anodic polarization in sodium hydroxide for 10 hours at the concentration and current densities reported in Table I.

TABLE I

| Sample No. | NaOH Solution % by wt. | Current Density $kA/m^2$ |
|---|---|---|
| 1 | 10 | 1 |
| 2 | 10 | 3 |
| 3 | 20 | 1 |
| 4 | 10 | 3 |
| 5 | 30 | 1 |
| 6 | 30 | 3 |

The sample coupons were used successfully as dimensionally stable anodes for cathodic protection. They were also tested as anodes for the electrolysis of a saturated sodium chloride aqueous solution at 60° C with a current density of 2.5 $kA/m^2$ for two days. The initial and final anode potentials and the amount of weight loss from the anode were determined. The results are reported in Table II.

TABLE II

| Sample No. | Anode Potential V (NHE) Initial Value | After 2 days of Operation | Weight Loss in $mg/cm^2$ |
|---|---|---|---|
| 1 | 2.10 | high | ≧0.5 |
| 2 | 2.06 | high | ≧0.5 |
| 3 | 2.02 | 2.20 | 1.5 |
| 4 | 1.48 | 1.48 | 0.6 |
| 5 | 1.49 | 1.70 | 1.2 |
| 6 | 1.50 | 1.72 | 1.1 |

The results of Table II show that the anode sample No. 4 has a particularly low anode potential which remained unchanged after 2 days of operation. Moreover, the metal weight loss at the same time was only 0.6 $mg/cm^2$.

EXAMPLE 2

Six titanium-nickel alloy coupons having a projected surface area of 4 $cm^2$ of the composition in Table III were sandblasted and then activated by anodic polarization in a 10% by weight sodium hydroxide solution at a current density of 3 $kA/m^2$ for 10 hours. The said coupons were than used as anodes to generate chlorine as in Example 1 and the initial and final anode potentials and final weight loss are reported in Table III.

TABLE III

| Sample No. | Alloy Composition % as Metal Ti | Ni | Anode Potential Initial Value V (NHE) | After 2 Days V (NHE) | Weight Loss $mg/cm^2$ |
|---|---|---|---|---|---|
| 1 | 95.0 | 5.0 | 1.49 | 1.50 | 0.5 |
| 2 | 90.0 | 10.0 | 1.40 | 1.45 | 0.8 |
| 3 | 80.0 | 20.0 | 1.39 | 1.42 | 1.5 |
| 4 | 70.0 | 30.0 | 1.38 | 1.43 | 1.7 |
| 5 | 60.0 | 40.0 | 1.35 | 1.36 | 1.9 |
| 6 | 50.0 | 50.0 | 1.40 | 1.69 | 2.2 |

Test coupons were also used satisfactorily as anodes for cathodic protection.

EXAMPLE 3

Four coupons having a projected surface area of 4 $cm^2$ and consisting of 98.5% titanium and 1.5% cobalt were sandblasted and then were activated by dipping into a molten salt bath as described in Table IV for 5 hours. The resulting samples were then used as anodes in chlorine evolution as in Table II of Example 1 and the anode potentials and weight loss were determined.

TABLE IV

| Sample No. | Molten Salt | Anode Potential V(NHE) Initial Value | After 2 Days of Operation | Weight Loss $mg/cm^2$ |
|---|---|---|---|---|
| 1 | $NaNO_3 + Ba(NO_3)_2$ | 2.0 | high | ≧0.5 |
| 2 | $NaNO_3$ | 2.0 | high | ≧0.5 |
| 3 | $K_2S_2O_8$ | 2.0 | 2.20 | 3.0 |
| 4 | $K_4P_2O_7$ | 2.0 | high | ≧0.5 |

EXAMPLE 4

Four titanium-cobalt coupons of the composition of Table V with a projected surface area of 4 $cm^2$ were sandblasted and then were activated by dipping in molten potassium persulfate for 5 hours. The resulting samples were then used for chlorine evolution as in Table II of Example 1 and the anode potential and weight loss were determined.

TABLE V

| Sample No. | Alloy Composition % by Weight Ti | Co | Anode Potential Initial Value | V(NHE) After 2 days | Weight Loss $mg/cm^2$ |
|---|---|---|---|---|---|
| 1 | 98.5 | 1.5 | 2.01 | 2.19 | 3.6 |
| 2 | 90.0 | 10.0 | 1.86 | 1.93 | 0.8 |
| 3 | 70.0 | 30.0 | 1.50 | 1.50 | 0.2 |
| 4 | 50.0 | 50.0 | 1.60 | 1.89 | 0.2 |

The results of Table V shows that the anode of sample No. 3 has a particularly low anode potential which remained unchanged after 2 days operation. Moreover, the metal weight loss at the same time was only 0.2 $mg/cm^2$.

EXAMPLE 5

Four coupons consisting of 98.5% titanium and 1.5% iron and having a projected surface area of 4 $cm^2$ were sandblasted and then were heated in an oxygen atmosphere for four hours at the temperatures in Table VI and then for three hours in a nitrogen atmosphere. The coupons were cooled in a nitrogen atmosphere at a rate of 50° C. per hour and were then used as anodes for chlorine evolution as in Example 1. The anode potentials and weight losses were then determined to be as follows:

TABLE VI

| Sample No. | Thermal Activation in °C. Oxygen Atmosphere | Nitrogen Atmosphere | Anode Potential V (NHE) Initial Value | After 2 Days | Weight loss $mg/cm^2$ |
|---|---|---|---|---|---|
| 1 | 500 | 500 | 2.20 | high | ≧0.5 |
| 2 | 600 | 500 | 1.95 | 2.38 | 0.9 |
| 3 | 650 | 500 | 2.36 | 2.90 | 0.5 |
| 4 | 700 | 500 | >3.0 | high | ≧0.5 |

EXAMPLE 6

Four titanium-iron coupons having a projected area of 4 $cm^2$ and the composition of Table VII were sandblasted and then heated at 600° C. for four hours in an oxygen atmosphere followed by heating for three hours at 500° C. in a nitrogen atmosphere. The samples were cooled in the nitrogen atmosphere at a rate of 50° C. per hour and were then used for chlorine evolution as in Table II of Example 1. The results are reported in Table VII.

TABLE VII

| Sample No. | Alloy Composition % by Weight Ti | Fe | Anode Potential V(NHE) Initial Value | After 2 Days | Weight Loss $mg/cm^2$ |
|---|---|---|---|---|---|
| 1 | 98.5 | 1.5 | 1.96 | 2.39 | 1.1 |
| 2 | 90.0 | 10.0 | 1.90 | 1.99 | 1.5 |
| 3 | 70.0 | 30.0 | 1.47 | 1.47 | 1.6 |
| 4 | 50.0 | 50.0 | 1.50 | 2.51 | 1.9 |

The results of Table VII show that the anode of sample No. 3 has a particularly low anode potential which remained unchanged after 2 days of operation.

EXAMPLE 7

Seven coupons of different titanium alloys having a projected surface area of 4 $cm^2$ were sandblasted and then were activated by dipping into molten potassium persulfate for five hours. The resulting coupons were then used for chlorine evolution as in Table II of Example I and the results are reported in Table VIII.

TABLE VIII

| Sample No. | Alloy % Ti | Co | Nz | Pb | Mn | Sn | Anode Potential Composition V (NHE) Initial Value | After 2 Days | Weight Loss $mg/cm^2$ |
|---|---|---|---|---|---|---|---|---|---|
| 1 | 50 | 25 | 25 | — | — | — | 2.05 | high | ≧0.5 |
| 2 | 70 | — | — | 30 | — | — | 2.02 | 2.06 | Negligible |
| 3 | 50 | — | — | 50 | — | — | 1.81 | 1.81 | 16.3 |
| 4 | 70 | — | — | — | 30 | — | 3.06 | high | ≧0.5 |
| 5 | 50 | — | — | — | 50 | — | 1.90 | 1.92 | 25.5 |
| 6 | 50 | — | — | 25 | — | 25 | 1.60 | 1.60 | 0.5 |
| 7 | 50 | 25 | — | 25 | — | — | 1.36 | 1.37 | 0.4 |

The results of Table VIII show that it is possible, by varying the composition of the alloys to obtain alloys with low anode potentials and low weight losses.

EXAMPLE 8

Six titanium-nickel coupons having a projected surface area of 4 $cm^2$ were sandblasted and then were used without further treatment as anodes for oxygen evolution in the electrolysis of an aqueous 10% sulfuric acid solution at 60° C. at current densities of 1.2 and 6 $kA/m^2$. The anode potentials and the weight loss were determined. The results are in Table IX.

TABLE IX

| Sample No. | Alloy Composition % as Metal Ti | Ni | Anode Potential V (NHE) At 1.2 $kA/m^2$ Initial Value | 40 Days | At 6.0 $kA/m^2$ Initial | 40 Days | Metal Weight Loss $mg/cm^2$ |
|---|---|---|---|---|---|---|---|
| 1 | 70 | 30 | 2.12 | 2.8 | | | negligible |
| 1a | 70 | 30 | | | 2.50 | high | ≧0.5 |
| 2 | 60 | 40 | 1.95 | 1.98 | | | negligible |
| 2a | 60 | 40 | | | 2.07 | 2.30 | 0.7 |
| 3 | 50 | 50 | 1.50 | 1.86 | | | negligible |
| 3a | 50 | 50 | | | 1.88 | 2.12 | 1.6 |

These anodes may be used in metal electrowinning processes.

EXAMPLE 9

Fourteen titanium alloy coupons of various compositions as given in Table X, having a projected surface area of 4 $cm^2$, were sandblasted and were then used without further treatment as anodes for the evolution of oxygen by electrolysis of an aqueous 10% sulfuric acid solution at 70° C. and current densities of 1.2 and 6 $kA/m^2$. The anode potentials and weight losses are reported in Table X.

TABLE X

| Sample No. | Alloy Composition % by Weight Ti | Co | Ni | Pb | Mn | Sn | Anode Potential V (NHE) At 1.2 $kA/m^2$ Initial Value | After 40 days | At 6.0 $kA/m^2$ Initial Value | After 40 Days | Weight Loss $mg/cm^2$ |
|---|---|---|---|---|---|---|---|---|---|---|---|
| 1 | 50 | 25 | 25 | — | — | — | 1.78 | 1.84 | — | — | neglig. |
| 1A | 50 | 25 | 25 | — | — | — | — | — | 1.85 | 1.85 | 1.2 |

TABLE X-continued

| Sample No. | Alloy Composition % by Weight Ti | Co | Ni | Pb | Mn | Sn | Anode Potential V (NHE) At 1.2 kA/m² Initial Value | After 40 days | At 6.0 kA/m² Initial Value | After 40 Days | Weight Loss mg/cm² |
|---|---|---|---|---|---|---|---|---|---|---|---|
| 2 | 70 | — | — | 30 | — | — | 2.56 | 2.79 | — | — | 20.7 |
| 2A | 70 | — | — | 30 | — | — | — | — | 2.80 | high | ≧0.5 |
| 3 | 50 | — | — | 50 | — | — | 2.07 | 2.18 | — | — | 130.7 |
| 3A | 50 | — | — | 50 | — | — | — | — | 2.26 | high | ≧0.5 |
| 4 | 70 | — | — | — | 30 | — | 2.21 | 2.33 | — | — | 121.3 |
| 4A | 70 | — | — | — | 30 | — | — | — | 2.40 | high | ≧0.5 |
| 5 | 50 | — | — | — | 50 | — | 2.01 | 2.07 | — | — | 396.8 |
| 5A | 50 | — | — | — | 50 | — | — | — | 2.19 | 2.34 | 12.7 |
| 6 | 50 | — | — | 25 | — | 25 | 1.87 | 1.97 | — | — | 2.4 |
| 6A | 50 | — | — | 25 | — | 25 | — | — | 1.95 | 2.08 | 3.9 |
| 7 | 50 | 25 | — | 25 | — | — | 1.97 | 2.18 | — | — | 11.0 |
| 7A | 50 | 25 | — | 25 | — | — | — | — | 2.10 | 2.34 | 195.6 |

In this test, Samples No. 1 (and 1A) appear to be the best for use in electrolysis processes in which oxygen is evolved at the anode, such as in metal electrowinning processes.

EXAMPLE 10

Four coupons of a silicon-iron alloy consisting of 84% iron, 15.1% silicon, 0.9% molybdenum and traces of carbon and nitrogen with a surface of 4 cm² projected area were cleaned by sandblasting and were then heated in a furnace in an oxygen atmosphere for five hours at temperatures of 600°to 900° C. The samples were then slowly cooled in an oxygen atmosphere at a cooling rate of 50° C. per hour. The resulting samples were then used as anodes for chlorine evolution in a saturated sodium chloride aqueous solution at 60° C. with a current density of 2.5 kA/m² for five days. The initial and final anode potential and the amount of weight loss are reported in Table XI.

TABLE XI

| Sample No. | Heating Temp. °C. | Anode Potential V (NHE) Initial Value | After 5 Days | Weight Loss In mg/cm² |
|---|---|---|---|---|
| 1 | 600 | 1.8 | 2.8 | 2.5 |
| 2 | 700 | 1.89 | high | ≧0.5 |
| 3 | 800 | 1.80 | 2.5 | 2.3 |
| 4 | 900 | 2.10 | high | ≧0.5 |

EXAMPLE 11

Four coupons of the silicon-iron alloy as used in Example 10 were sandblasted and then were first heated at the temperatures given in Table XII, in a furnace with an oxygen atmosphere for five hours and secondly heated in a nitrogen atmosphere for five more hours. The coupons were then slowly cooled in a nitrogen atmosphere at a rate of 50° C. per hour. The temperature was the same in each heating step for the individual coupons. The sample coupons were then used as anodes as in Example 1 for the evolution of chlorine for ten days and the results are reported in Table XII.

TABLE XII

| Sample No. | Heating Temp. °C. | Anodic Potentials Initial Value | After 10 Days Of Operation | Weight Loss in mg/cm² |
|---|---|---|---|---|
| 1 | 500 | 1.60 | 1.68 | negligible |
| 2 | 700 | 1.70 | 1.75 | negligible |
| 3 | 800 | 1.50 | 1.50 | negligible |
| 4 | 900 | 1.98 | high | ≧0.5 |

Table XII shows that the best anodic potential for chlorine evolution was obtained with the test coupons heated to 800° C. The coupons were also used satisfactorily as stable anodes for cathodic protection.

EXAMPLE 12

Sintered materials obtained by a mixture of metal powders of mesh Nos. comprised between 60 and 320 and having composition as indicated hereinbelow in Table XIII have been used as anodes for the electrolysis of $H_2SO_4$ 10% solution at 60° C. under a current density over projected area of 1.2 KA/m². The experimental results are summarized in Table XIII.

TABLE XIII

| Composition of sintered material % by weight Ti | Co | Ni | $TiO_2$ | $RuO_2$ | Anode Potential V (NHE) Initial Value | After 10 Days | Weight Loss mg/cm² |
|---|---|---|---|---|---|---|---|
| 93 | 0 | 3 | 4 | 0 | 2.39 | 2.40 | 1.5 |
| 93 | 0 | 2 | 4 | 1 | 1.60 | 1.61 | negligible |
| 93 | 1 | 1 | 4 | 1 | 1.56 | 1.58 | negligible |
| 90 | 3 | 3 | 3 | 1 | 1.54 | 1.56 | negligible |

The following remarks can be made:

I The presence of $RuO_2$ sharply improves the catalytic activity for oxygen evolution.

II The addition of cobalt slightly increases the catalytic activity for the oxygen evolution.

III The addition of $RuO_2$ or cobalt and $RuO_2$ sharply decrease the metal weight loss.

The last three samples are very suitable to their use as anodes in electrolysis processes in which oxygen is evolved at the anode, such as in most metal electrowinning processes.

EXAMPLE 13

Sintered materials obtained by a mixture of metal powders of mesh Nos. comprised between 60 and 320 and having composition as indicated in Table XIV have been used as anodes for the electrolysis of $H_2SO_4$ 10% solution at 60° C. under a current density over projected area of 1.2 KA/m².

The experimental results are summarized in Table XIV.

TABLE XIV

| Composition of sintered material % by weight Ti | Co | Ni | $TiO_2$ | Ir | $IrO_2$ | Anode potential V (NHE) Initial value | After 10 Days | Metal Weight Loss mg/cm |
|---|---|---|---|---|---|---|---|---|
| 93 | 0 | 3 | 4 | 0 | 0 | 2.30 | 2.40 | 1.5 |

TABLE XIV-continued

| Composition of sintered material % by weight | | | | | | Anode potential V (NHE) | | Metal Weight Loss |
|---|---|---|---|---|---|---|---|---|
| Ti | Co | Ni | $TiO_2$ | Ir | $IrO_2$ | Initial value | After 10 Days | mg/cm |
| 93 | 0 | 2 | 4 | 0 | 1 | 1.60 | 1.63 | negligible |
| 93 | 0 | 1 | 4 | 1 | 1 | 1.54 | 1.54 | negligible |
| 93 | 1 | 1 | 3 | 1 | 1 | 1.53 | 1.53 | negligible |

The three last samples are characterized by a low anodic potential which remained substantially uncharged after 10 days of operation and by a extremely low metal weight loss.

EXAMPLE 14

Sintered materials obtained by a mixture of metal powders of mesh Nos. comprised between 60 and 320 and having composition as indicated in Table XV have been used as anodes for the electrolysis of $H_2SO_4$ 10% solution at 60° C. under a current density over projected area of 1.2 KA/m$^2$.

The experimental results are indicated in the following Table.

TABLE XV

| Composition of sintered material % by weight | | | | | Anode Potential V(NHE) | | Metal Weight Loss |
|---|---|---|---|---|---|---|---|
| Ti | Co | Ni | Pt | Ir | Initial Value | After 10 Days | mg/cm$^2$ |
| 93 | 0 | 7 | 0 | 0 | 2.2 | 2.7 | 8.0 |
| 93 | 0 | 5 | 2 | 0 | 2.0 | 2.2 | 1.5 |
| 93 | 0 | 5 | 0 | 2 | 1.70 | 1.72 | negligible |
| 93 | 0 | 5 | 1 | 1 | 1.68 | 1.70 | negligible |
| 93 | 2.5 | 2.5 | 1 | 1 | 1.67 | 1.68 | negligible |

The three last samples show a low anodic potential and an extremely low metal weight loss which makes them very useful as anodes for electrolysis processes wherein oxygen is evolved at the anode.

EXAMPLE 15

Sintered materials obtained by a mixture of metal powders of mesh Nos. comprised between 60 and 320 and having composition as indicated in Table XVI have been used as anodes for the electrolysis of the $H_2SO_4$ 10% solution at 60° C. under a current density over projected area of 1.2 KA/m$^2$.

The experimental results are indicated in the following Table.

TABLE XVI

| Composition of sintered material % by weight | | | | Anode Potential V (NHE) | | Metal Weight Loss |
|---|---|---|---|---|---|---|
| Ti | $Co_3O_4$ | $Fe_3O_4$ | $RuO_2$ | Initial Value | After 10 Days | mg/cm$^2$ |
| 90 | 10 | 0 | 0 | 1.90 | 2.0 | 1.5 |
| 90 | 0 | 10 | 0 | 1.97 | 2.10 | 2.5 |
| 90 | 2.5 | 5.0 | 2.5 | 1.80 | 1.80 | negligible |
| 90 | 5 | 5 | 0 | 1.83 | 1.87 | negligible |
| 90 | 2.5 | 2.5 | 5 | 1.77 | 1.78 | negligible |

The following remarks can be made:

I The addition of $RuO_2$ sharply improves the catalytic activity for oxygen evaluation.

II The addition of $Co_3O_4+Fe_3O_4$ slightly increases the catalytic activity.

III The addition of $RuO_2$ and/or $Co_3O_4+Fe_3O_4$ sharply lower the metal weight loss.

The last three samples show a low anodic potential and a very good resistance to corrosion.

EXAMPLE 16

Sintered materials obtained by a mixture of metal powders with mesh Nos. comprised between 60 and 320 and having a composition as indicated in Table XVII have been tested as anodes for the electrolysis of $H_2SO_4$ 10% solution at 60° C. and at a current density of 1.2 KA/m$^2$.

The experimental results are detailed in Table XVII.

TABLE XVII

| Composition of sintered material % by weight | | | | | Anode Potential V (NHE) | | Weight Loss |
|---|---|---|---|---|---|---|---|
| Fe | Co | Cr | W | Si | Initial Value | After 10 Days | mg/cm$^2$ |
| 60 | 20 | 5 | 15 | 0 | 1.9 | 1.9 | 20 |
| 60 | 20 | 5 | 10 | 5 | 2.1 | 2.1 | negligible |
| 60 | 10 | 5 | 15 | 10 | 2.0 | 2.1 | negligible |
| 60 | 10 | 10 | 5 | 15 | 2.0 | 2.3 | negligible |

The addition of Silicon greatly improves the metal corrosion resistance while lowering slightly the catalytic activity for oxygen evolution.

EXAMPLE 17

Sintered materials obtained by a mixture of metal powders with mesh Nos. comprised between 60 and 320 and having composition as indicated in Table XVIII have been tested as anodes for the electrolysis of $H_2SO_4$ 10% solution at 60° C. and area current density of 1.2 KA/m$^2$.

The experimental results are reported in the following Table.

TABLE XVIII

| Composition of sintered material % by weight | | | Anode Potential V(NHE) | | Weight Loss |
|---|---|---|---|---|---|
| Ti | $SnTa_2O$ | $IrTa_2O_7$ | Initial Value | After 10 Days | mg/cm$^2$ |
| 80 | 20 | 0 | 1.7 | 1.7 | negligible |
| 90 | 0 | 10 | 1.5 | 1.5 | negligible |

The presence of metallates in the valve metal matrix sharply increases the electrocatalytic activity for oxygen evolution while their presence does not effect the very good corrosion resistance.

EXAMPLE 18

Sintered materials of similar composition as described in Example 12 have been pre-activated by dipping the test coupons in a molten potassium persulfate bath for 5 hours. They were then tested as anodes for the electrolysis of a saturated sodium chloride aqueous solution at 60° C. with a current density of 5 KA/m$^2$.

The experimental results are reported in the following Table.

TABLE XIX

| Composition of sintered Material % by weight | | | | | Anode Potential V(NHE) | | Weight Loss |
|---|---|---|---|---|---|---|---|
| Ti | Co | Ni | $TiO_2$ | $RuO_2$ | Initial Value | After 10 Days | mg/cm$^2$ |
| 93 | 0 | 3 | 4 | 0 | 2.9 | 3.3 | 10 |
| 93 | 0 | 2 | 4 | 1 | 1.70 | 1.75 | 2.0 |
| 93 | 1 | 1 | 4 | 1 | 1.68 | 1.70 | 1.0 |

TABLE XIX-continued

| Composition of sintered Material % by weight | | | | | Anode Potential V(NHE) | | Weight Loss |
|---|---|---|---|---|---|---|---|
| Ti | Co | Ni | $TiO_2$ | $RuO_2$ | Initial Value | After 10 Days | mg/cm² |
| 90 | 3 | 3 | 3 | 1 | 1.65 | 1.69 | 1.0 |

The presence of $RuO_2$ sharply improves the catalytic activity for chlorine evolution and the metal weight loss is sharply reduced. Addition of Cobalt and Nickel further improves the performance of the anodes.

EXAMPLE 19

Sintered materials of similar composition as described in Example 13 has been pre-activated by anodic polarization in a 10% by weight sodium hydroxide solution at a current density of 3 KA/m² for 10 hours. The test coupons were then tested as anodes for the electrolysis of a saturated sodium chloride aqueous solution at 60° C. with a current density of 5 KA/m².

The experimental results are reported in the following Table.

TABLE XX

| Composition of sintered material % by weight | | | | | | Anode Potential V (NHE) | | Weight Loss |
|---|---|---|---|---|---|---|---|---|
| Ti | Co | Ni | $TiO_2$ | Ir | $IrO_2$ | Initial Value | After 10 Days | mg/cm² |
| 93 | 0 | 3 | 4 | 0 | 0 | 2.55 | 2.60 | 10 |
| 93 | 0 | 2 | 4 | 0 | 1 | 1.85 | 1.88 | 2.5 |
| 93 | 0 | 1 | 4 | 1 | 1 | 1.73 | 1.74 | 1.6 |
| 93 | 1 | 1 | 3 | 1 | 1 | 1.60 | 1.60 | 1.5 |

Test sample No. 4 shows a low anode potential which remained unchanged after 10 days of operation. The metal weight loss for the same period was 1.5 mg/cm².

EXAMPLE 20

Sintered materials of similar composition as described in Example 14 have been pre-activated by anodic polarization in a 10% by weight sodium hydroxide solution at a current density of 3 KA/m² for 10 hours.

The test coupons were then tested as anodes for the electrolysis of a saturated sodium chloride aqueous solution at 60° C. with a current density of 5 KA/m².

The experimental results are reported in the following Table.

TABLE XXI

| Composition of sintered material % by weight | | | | | Anode Potential V (NHE) | | Weight Loss |
|---|---|---|---|---|---|---|---|
| Ti | Co | Ni | Pt | Ir | Initial Value | After 10 Days | mg/cm² |
| 93 | 0 | 7 | 0 | 0 | 2.3 | 3.0 | 20 |
| 93 | 0 | 5 | 2 | 0 | 2.2 | 2.5 | 10 |
| 93 | 0 | 5 | 0 | 2 | 2.0 | 2.3 | 5 |
| 93 | 0 | 5 | 1 | 1 | 1.65 | 1.67 | 2 |
| 93 | 2.5 | 2.5 | 1 | 1 | 1.60 | 1.60 | 1 |

The two last samples of the table show a low anode potential for chlorine evolution which remained pratically unchanged after ten days of operation. The corresponding metal weight losses were also low.

EXAMPLE 21

Sintered materials of similar composition as described in Example 15 have been pre-activated by anodic polarization in a 10% by weight sodium hydroxide solution at a current density of 3 KA/m² for 10 hours. The test coupons were then tested as anodes for the electrolysis of a saturated sodium chloride aqueous solution at 60° C. with a current density of 5 KA/m².

The experimental results are reported in the following Table.

TABLE XXII

| Composition of sintered Material % by weight | | | | Anode Potential V(NHE) | | Weight Loss |
|---|---|---|---|---|---|---|
| Ti | $Co_3O_4$ | $Fe_3O_4$ | $RuO_2$ | Initial value | After 10 days | mg/cm² |
| 90 | 10 | 0 | 0 | 2.10 | 2.20 | 20 |
| 90 | 0 | 10 | 0 | 1.97 | 1.98 | 10 |
| 90 | 0 | 0 | 10 | 1.90 | 1.93 | negligible |
| 90 | 5 | 5 | 0 | 1.57 | 1.57 | negligible |
| 90 | 2.5 | 2.5 | 5 | 1.45 | 1.45 | negligible |

The last test sample in the table shows a remarkably low anode potential for chlorine evolution associated with very good corrosion resistance.

EXAMPLE 22

Sintered materials of similar composition as described in Example 17 have been pre-activated by anodic polarization in a 10% by weight sodium hydroxide solution at a current density of 3 KA/m² for 10 hours.

The test coupons were then tested as anodes for the electrolysis of a saturated sodium chloride aqueous solution at 60° C. with current density of 5 KA/m².

The experimental results are reported in the following Table.

TABLE XXIII

| Composition of sintered material % by weifht | | | Anode potential V(NHE) | | Weight Loss |
|---|---|---|---|---|---|
| Ti | $SnTa_2O_7$ | $IrTa_2O_7$ | Initial Value | After 10 Days | mg/cm² |
| 80 | 20 | 0 | 1.7 | 1.75 | negligible |
| 90 | 0 | 10 | 1.5 | 1.55 | negligible |

The addition of metallates to the valve metal matrix sharply increases the catalytic activity.

The last test sample in the table shows a low anode potential for chlorine evolution and a very good corrosion resistance.

Anodes prepared according to the invention, and comprising other film forming metals such as the valve metals tantalum, zirconium, niobium, vanadium, hafnium, tungsten and molybdenum and film forming iron alloys alloyed or sinterized with other metals, metal oxides, intermetallic compounds and metallates which provides on the surface of the film forming matrix active nuclei which interrupt the nonconductive barrier layer and permit the formation of an electrically conductive and electrocatalytic film thereon, may also be prepared and used in electrolysis processes for chlorine evolution, oxygen evolution and other purposes such as fused salt electrolysis, electrowinning, electrophoresis, organic and aqueous solutions electrolysis, cathode protection and the like.

The electrodes produced according to Examples 1 to 26 may be connected into an electrolysis cell circuit in any desired manner and are provided with suitable means to make connection to a source of electrolysis current in diaphragm or mercury cathode chlorine cells, electrowinning cells or any other type of electrolysis cells.

As will be seen from the various examples, the electrodes of this invention may be used in chlorine and oxygen evolution and other electrolysis processes by merely preactivating the alloy composition (or a portion of the alloy composition) forming the surface of the electrode. The activation layer is formed from the alloy at the surface of the electrode, without the application of a separate coating layer, and is, therefore, cheaper to produce, more adherent to the surface of the electrode and more easily restored (re-activated) after use if necessary than the separately applied coatings of the prior art moreover in some uses (i.e., oxygen evolution), the activation layer is self-generating and regenerating in service—thereby giving long life, inexpensive anodes for use particularly in metal electrowinning, which do not add impurities to the metal being recovered.

Various modifications of the products and processes of the invention may be made without departing from the spirit or scope thereof and it should be understood that the invention is not limited by the illustrative examples given and is intended to be limited only as defined in the appended claims.

We claim:

1. In the method of electrowinning metals from an aqueous acid electrolyte solution containing dissolved metals therein in an electrolysis cell containing a cathode, and means to pass an electrolysis current through said cell between an anode and a cathode, the novel steps which comprise inserting an anode comprising titanium alloyed with 1 to 50% by weight of at least one metal from Groups VIB, VIIB, VIII, IIB, IB, IVA and lanthanum and lanthanide series of the Periodic Table into said electrolyte and passing an electrolysis current through said cell to release oxygen at said anode and deposit dissolved metal from said solution on the cathode.

2. The method of claim 1, in which the anode is an alloy of titanium and from 1 to 50% by weight of a metal from the group consisting of cobalt, nickel, lead, iron, manganese and tin.

3. The method of electrowinning metal in an electrolysis cell containing an anode, a cathode and an acid aqueous electrolyte solution containing the metal to be recovered, which comprises using as the anode an electrically conductive base having at least its outer surface containing a film forming metal or alloy and 0.1 to 50% by weight of at least one member of the group consisting of metals from Groups VIB, VIIB, VIII, IIB, IB, IVA and lanthanum and lanthanide series of the Periodic Table alloyed with the film forming metal, and passing an electrolysis current through said anode and electrolyte to deposit the desired metal on the cathode.

4. The method of claim 3, in which the outer surface of the anode is an alloy of titanium with 1 to 50% by weight of one or more metals from the group consisting of manganese, rhenium iron, cobalt, nickel, cadmium, tin, lead and silicon.

5. A method of electrowinning metal comprising electrolyzing an aqueous solution of metal using as an anode an alloy containing one or more film-forming metals selected from the group consisting of titanium, zirconium, niobium and tantalum and one or more of the elements of atomic numbers 24-28 of the Periodic System of Elements, the amount of elements 24-28 being greater than that at which passivation occurs and less than 50% by weight of the alloy.

6. A method as claimed in claim 5 in which the alloy is a titanium-manganese alloy, manganese being present in an amount of 30 to 50 weight %.

7. A method as claimed in claim 5 in which the alloy is a nickel-titanium alloy, nickel being present in an amount in the range of 35–50%.

8. A method as claimed in claim 5 in which the anode is a solid anode formed of the alloy.

9. A method as claimed in claim 5 in which the alloy is an iron-titanium alloy, iron being present in the range of 50–20% by weight.

10. A method as claimed in claim 5 in which the alloy is a titanium-cobalt alloy, cobalt being present in an amount in the range of 30 to 50% by weight.

11. A method of recovering an electrowinnable metal from an aqueous solution of the metal which comprises the steps of inserting an anode and a cathode into the aqueous solution, connecting the anode to a positive potential with respect to the cathode, passing an electrical current through the anode and the cathode to electrodeposit the metal onto the cathode and removing the cathode deposited metal from the solution, characterized in that the anode has as its electrically conducting surface an alloy containing one or more high melting point passive film-forming metals selected from the group consisting of titanium, zirconium, niobium and tantalum and one or more of the elements of atomic numbers 24-28 of the Periodic System of Elements, the amount of elements 24-28 being greater than that at which passivation of the alloy occurs and less than 50% by weight of the alloy.

12. The method of electrolysis which comprises using a surface oxidized alloy of titanium and 1 to 50% by weight of at least one member of the group consisting of metals from Groups VIB, VII, VIII, IIB, IB, IVA and lanthanum and lanthanide series of the Periodic Table, as an anode in an electrolysis cell containing an acid aqueous metal containing electrolyte and a cathode, connecting the said anode and cathode with a source of electrolysis current, passing current through the electrolyte and recovering electrolysis products from said cell.

* * * * *

UNITED STATES PATENT AND TRADEMARK OFFICE

CERTIFICATE OF CORRECTION

PATENT NO. : 4,288,302

DATED : September 8, 1981

INVENTOR(S) : VITTORIO DE NORA ET AL.

It is certified that error appears in the above—identified patent and that said Letters Patent is hereby corrected as shown below:

Column 1, line 42: "throught" should read -- through --.

Column 3, line 1: "the", first occurrence, should read -- The --.

Column 5, lines 57 and 58; Column 6, lines 39, 40 and 42; Column 7, lines 32 and 35; Column 8, lines 14, 17 and 41, Column 9, lines 2, 4, and 6 of Table X; Column 9, lines 42, 44 and 67: " $\geqq$ " should read -- $\geq$ --.

Column 8, Table VIII: The heading of said table should read:

| -- Sample No. | Alloy Composition % | Anode Potential V(NHE) -- |
|---|---|---|

Column 9, line 64: (Table XII): "500" should read -- 600 --.

Signed and Sealed this

Twenty-ninth Day of December 1981

[SEAL]

Attest:

GERALD J. MOSSINGHOFF

Attesting Officer

Commissioner of Patents and Trademarks